US006351063B1

(12) United States Patent
Lee et al.

(10) Patent No.: US 6,351,063 B1
(45) Date of Patent: Feb. 26, 2002

(54) COMPOSITION FOR FORMING CONDUCTIVE FILM METHOD FOR PREPARING THE SAME AND DISPLAY DEVICE EMPLOYING CONDUCTIVE FILM FORMED USING THE COMPOSITION

(75) Inventors: Ji-won Lee; Jong-hwan Park, both of Suwon; Myun-ki Shim, Seoul; Dong-sik Zang, Suwon, all of (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/478,412

(22) Filed: Jan. 6, 2000

(30) Foreign Application Priority Data

Jan. 13, 1999 (KR) ..... 99-716
Jan. 13, 1999 (KR) ..... 99-717

(51) Int. Cl.[7] ..... H01J 31/00
(52) U.S. Cl. ..... 313/479

(58) Field of Search ..... 313/477, 479, 313/635, 313

*Primary Examiner*—Vip Patel
(74) *Attorney, Agent, or Firm*—Leydig, Voit, & Mayer, Ltd.

(57) ABSTRACT

A composition for forming a conductive film, a method for preparing the same, and a cathode ray tube (CRT) employing the conductive film formed using the composition are disclosed. In the composition for forming a conductive film according to the present invention, conductive black pigment particles are bonded to a network of an organic-inorganic composite sol and are uniformly dispersed in the network. Thus, the conductive film prepared using the composition of the present invention is stable even under a change of conditions such as temperature or humidity. Further, a CRT employing the conductive film formed using the conductive composition of the present invention is excellent in view of contrast characteristics, resolution and film properties, and has an improved body color and a good picture image.

20 Claims, 1 Drawing Sheet

COMPOSITION FOR FORMING CONDUCTIVE FILM METHOD FOR PREPARING THE SAME AND DISPLAY DEVICE EMPLOYING CONDUCTIVE FILM FORMED USING THE COMPOSITION

BACKGROUND OF THE INVENTION

1. Field of the Invention

The present invention relates to a composition for forming a conductive film, and more particularly, to a composition for forming a conductive film to be coated on the outer surface of a panel of a cathode ray tube (CRT), the composition having an improved bonding property between the components thereof and a dispersing property of the components thereof, a method for preparing the same, and a CRT employing the conductive film formed using the composition to thereby improve a contrast characteristic and film properties such as film hardness or chemical/mechanical film stability.

2. Description of the Related Art

An image is formed on a CRT by an electron beam emitted from an electron gun, which is selectively deflected by a deflection yoke according to landing positions and lands on a phosphor layer formed on the inner surface of a panel to thus excite the phosphor causing it to luminesce.

A curved panel having a predetermined curvature is typically used as the panel of a CRT. Although curved panels are disadvantageous in view of attaining a high-quality image, due to severe glare and image distortion at the peripheral portion thereof, they are still chiefly used as panels for CRTs due to technical difficulties in manufacturing flat panels.

However, due to recent advances in the technologies used to manufacture flat panels, existing curved panels are being replaced by flat panels having a curvature close to infinity.

A panel having a large curvature, that is, a nearly flat panel, can realize a clean image by suppressing glare due to reflection of external light, reduce eye fatigue and eliminate distortion of an image.

As an example of a flat panel, a panel shown in FIG. 1, whose internal and external surfaces are both completely flat, has been proposed. In a CRT employing such a flat panel, an image formed on the central portion of the panel appears to recede inwardly.

To overcome this problem, as shown in FIG. 2, a flat panel having a completely flat external surface and a curved internal surface having a predetermined curvature has been proposed.

However, according to this flat panel, it is difficult to attain a uniform image due to different transmittances between the central portion and the peripheral portion of the panel, which is caused by a difference in the thicknesses of the central and peripheral portions. Also, in the case of employing a general dark tint panel or a semi-tint panel having a transmittance of about 40~50% as the flat panel, the difference between the transmittances of the central portion and the peripheral portion of the panel becomes bigger.

Therefore, the present invention is for forming a conductive film having excellent contrast characteristics and improved film properties to overcome the above-mentioned problems.

SUMMARY OF THE INVENTION

To solve the above problems, it is an objective of the present invention to provide a composition having a property of improved bonding between the components thereof and a property of improved dispersion of the components thereof, for forming a conductive film to be coated on the outer surface of a panel of a CRT.

It is another objective of the present invention to provide a method for preparing a composition for forming the conductive film.

It is still another objective of the present invention to provide a cathode ray tube having excellent contrast characteristics and film properties due to the use of a conductive film formed using the composition.

Accordingly, to achieve the first objective, there is provided a composition for forming a conductive film to be coated on the outer surface of a panel of a cathode ray tube, the composition including conductive black pigment particles, pigment particles for adjusting the transmittance of light at different wavelengths, a conductive polymer, and at least one silica selected from the group consisting of siliconalkoxide and oligomers thereof, wherein the conductive black pigment particles and pigment particles for adjusting the transmittance of light at different wavelengths are bonded to a network of an organic-inorganic composite sol while being uniformly dispersed in the network.

To achieve the second objective, there is provided a method of preparing a composition for forming a conductive film to be coated on the outer surface of a panel of a cathode ray tube, the method including the steps of (a) dispersing conductive black pigment particles, at least one silica selected from the group consisting of silicon alkoxide and oligomers thereof, and a conductive polymer in an organic solvent mixture, to prepare an organic-inorganic composite sol, (b) dispersing pigment particles for adjusting the transmittance of light at different wavelengths, a dispersing agent and a conductive polymer in an organic solvent mixture to prepare a pigment composition, and (c) mixing the organic-inorganic composite sol and the pigment composition and subjecting to the mixture to ultrasonic dispersion.

To achieve the third objective, there is provided a cathode ray tube including a panel, and a conductive film formed on the outer surface of the panel using the composition according to the present invention.

DESCRIPTION OF THE PREFERRED EMBODIMENTS

Figure 1:
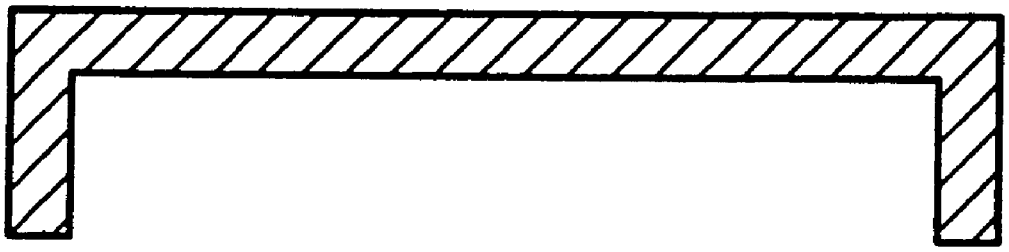
FIG. 1 is a sectional view showing an example of a flat panel.
Figure 2:
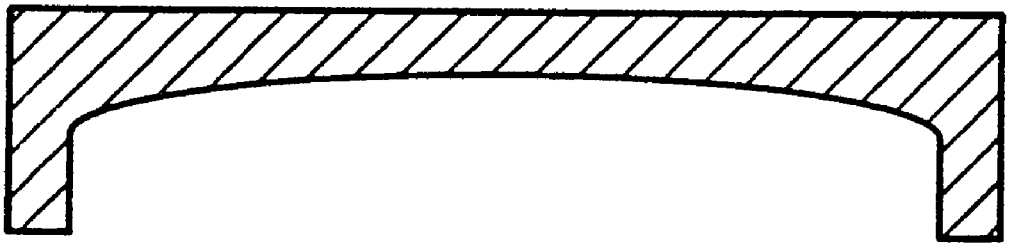
FIG. 2 is a sectional view showing another example of a flat panel.

First, in the composition according to the present invention, conductive black pigment particles are selected from the group consisting of carbon black and titanium black, and the average particle diameter thereof is preferably 5~300 nm. Carbon black is more preferably used.

Pigment particles for adjusting the transmittance of light at different wavelengths can be organic or inorganic pigments which are generally used in the art, preferably organic or inorganic pigments exhibiting excellent transmittance in the range of 400–700 nm so as to correct color difference of black pigments, and the average particle diameter thereof is preferably 5~300 nm.

The pigment particles for adjusting the transmittance of light at different wavelengths are preferably at least one pigment selected from the group consisting of phthalocyanine pigments (phthalocyanine-metal) having at lease one metal substituent such as copper, iron, manganese, cobalt or nickel, and violescent pigments. However, they are not limited thereto and any pigment that is used in the art can be employed.

Polymer having a π resonance structure and a conductivity can be used as a conductive polymer. Examples of conductive polymers include polypyrrole, polyacetylene, polyfuran, polyparaphenylene, polyserenophene, polythiophene, polyaniline and derivatives thereof in which side chain substituents or functional dopants are contained.

The composition according to the present invention may further comprise conductive particles of metal such as silver (Ag), gold (Au), platinum (Pt), copper (Cu), nickel (Ni), paladium (Pd), cobalt (Co), rhodium (Rh), ruthenium (Ru) or tin (Sn), and/or particles of metal oxide such as tin oxide, indium oxide, indium tin oxide (ITO), antimony oxide, antimony zinc oxide and antimony tin oxide, which, preferably, have an average particle diameter of 5~300 nm.

At least one binder selected from the group consisting of metal alkoxide, silicon alkoxide oligomer and a silane coupling agent may be further included in the composition of the present invention.

In the composition of the present invention, compound represented by formula, $(SiO)_n(OR)_{4-2}$, (wherein n is an integer selected from 0.5~1.5 and R is a $C_1$–$C_4$ alkyl) is preferably used as the silicon alkoxide oligomer. Here, it is preferable that the content of monomer is no more than 1 wt %.

The composition for forming a conductive layer of the present invention is useful for forming a conductive film on the outer surface of the panel of a CRT, especially a flat panel having different transmittances between the center portion and peripheral portion thereof.

In the method for preparing the composition according to the present invention, it is preferable that a step (a) is performed by dissolving conductive black pigment particles, pigment particles for adjusting the transmittance of light at different wavelengths, at least one silica selected from the group consisting of silicon alkoxide and oligomers thereof, and a conductive polymer in an organic solvent mixture, and then subjecting the resultant to an aging procedure. The aging procedure allows the organic-inorganic composite sol to be prepared easily in a shortened time. The aging procedure can be performed at the temperature of 50~60° C. for 2~4 hours.

Further, in the step (a), conductive particles selected from metals or metal oxides and/or at least one binder selected from the group consisting of metal alkoxide, silicon alkoxide oligomer and a silane coupling agent, may be further added. Here, metal, metal oxide and silicon alkoxide oligomer are the same as mentioned above.

In step (b), the pigment composition may be mechanically dispersed and/or subjected to ultrasonic dispersion.

The dispersing agent in the step (b) is for improving a dispersing property of the pigment particles for adjusting the transmittance of light at different wavelengths. An example of a preferred dispersing agent is a sulfone-group containing compound.

In steps (a) and (b), the above-described conductive polymer can be used, and the organic solvent mixtures are at least one selected from the group consisting of water, alcohol such as methanol, ethanol or isopropanol, dimethylformamide and methylcellosolve.

Alternatively, the composition for a conductive film according to the present invention can be prepared by dispersing conductive black pigment particles, pigment particles for adjusting the transmittance of light at different wavelengths, at least one silica selected from the group consisting of silicon alkoxide and oligomers thereof, and a conductive polymer, in an organic solvent mixture and then subjecting the resultant to ultrasonic dispersion.

Also, the composition for a conductive film according to the present invention can be prepared by mixing pigment particles for adjusting the transmittance of light at different wavelengths and a dispersing agent, with the organic-inorganic composite sol obtained in step (a) and then subjecting the resultant to ultrasonic dispersion.

In the reaction mechanism according to the present invention, first, the metal alkoxide is hydrolyzed and closslinked by condensation to make a network. Then, the conductive black pigment particles and the pigment particles for adjusting the transmittance of light at different wavelengths are partially bonded to the network while being uniformly dispersed therein.

Thus, the composition according to the present invention is characterized in that the conductive black pigment particles and the pigment particles for adjusting the transmittance of light at different wavelengths are not simply dispersed in silica-containing organic solvent mixture but are partially bonded to the network of an organic-inorganic composite-sol while being uniformly dispersed therein.

The conductive film prepared using the composition of the present invention is stable even under a change of conditions such as temperature or humidity.

Further, the conductive film formed using the conductive composition of the present invention, which is a conductive organic-inorganic hybrid silica layer, has excellent conductivity and contrast characteristics as well as a film hardness.

Also, the conductive film formed using the composition of the present invention provides a high-quality body color of the CRT since the conductive film includes the pigment particles for adjusting the transmittance of light at different wavelengths which serve to correct color difference of the black pigment, as well as the conductive black pigment particles.

Now, the present invention will be described in more detail with reference to an illustrative embodiment.

First, conductive black pigment particles, at least one silica selected from the group consisting of siliconalkoxide and oligomers thereof, and a conductive polymer, are dispersed in an organic solvent mixture. Then, the resultant is aged at the temperature of 50~60° C. for 2~4 hours, thereby preparing an organic-inorganic composite sol having a conductivity.

In preparing the organic-inorganic composite sol, conductive particles which are generally used in the art, such as metal or metal oxide particles, and/or at least one binder selected from the group consisting of metal alkoxide, silicon alkoxide oligomer and a silane coupling agent can be further added.

The pigment particles for adjusting the transmittance of light at different wavelengths and a dispersing agent are sequentially dispersed in an organic solvent mixture containing a conductive polymer, and then are subjected to ultrasonic dispersion, thereby preparing a pigment composition having excellent dispersing and coating properties.

Next, the organic-inorganic composite sol and the pigment composition are mixed. Then, the mixture is subjected to ultrasonic dispersion, thereby preparing the composition for forming a conductive film.

In the above-described method, the conductive black pigment particles and the pigment particles for adjusting the transmittance of light at different wavelengths must have an average particle diameter of 5~300 nm. If the average particle diameter is not within this range, white turbidity occurs on the conductive film, which undesirably lowers the resolution.

Finally, the thus-prepared composition for forming a conductive film is coated on the outer surface of a flat panel having different transmittances between the center portion and the peripheral portion thereof, by a conventional coating method such as spin coating, spray coating or dipping, dried and heated to form the conductive film.

The conductive film formed using the composition according to the present invention is transparent and is excellent in view of film characteristics, conductivity, anti-static characteristics, contrast characteristics and resolution. Further, the conductive film formed using the composition of the present invention provides a high-quality body color of the CRT employing the same.

Therefore, in the case of employing the conductive film formed using the composition according to the present invention, it is not necessary to further form a protective layer and an anti-static layer for the purpose of improving film stability of the conductive film. Accordingly, the manufacturing process is simplified and manufacturing cost is reduced.

The conductive film according to the present invention is suitable for large flat-panel CRTs, in particular flat-panel CRTs having a screen larger than 19 inches.

Now, the present invention will be described in more detail with reference to an illustrative embodiment, but is not limited thereto.

EXAMPLE 1

25 g of tetraethylorthosilicate (TEOS) and 10 g of carbon black were added to a solvent mixture prepared by dissolving 5 g of polyaniline in 100 g of ethanol and 50 g of water, stirred for 30 minutes, and then aged in a constant-temperature bath maintained at about 60° C. for about 4 hours to prepare an organic-inorganic composite sol.

Subsequently, 1 g of phthalocyanine blue was dissolved in a solution containing 5 g of polyaniline and 85 g of ethanol, and the resultant was ball-mill treated using 300 g of 0.3 mm-glass bead for 24 hours to prepare a phthalocyanine blue dispersing solution.

The thus-obtained organic-inorganic composite sol and phthalocyanine blue dispersing solution were mixed with a solvent mixture composed of 20 g of methanol, 10 g of butanol and 40 g of ethanol. Then, the resultant was dispersed using ultrasonic waves, thereby attaining a composition for forming a conductive film.

The thus-obtained composition for forming a conductive film was spin-coated on the outer surface of a 29-inch flat-panel CRT, having a transmittance of 83% in the central portion thereof and a transmittance of 76% in the peripheral portion thereof, and then heated at 200° C. for 30 minutes to form the conductive film.

The film state, film hardness, body color and appeal of the body color of the CRT having the conductive film, which are shown in Table 1, were measured.

EXAMPLE 2

With the exception of 5 g of titanium black (TiO) being used instead of carbon black, the composition for forming a conductive film was obtained in the same manner as described in Example 1, and the conductive film was formed using the composition. The film state, film hardness, body color and appeal of the body color of the CRT having the conductive film, which are shown in Table 1, were measured.

COMPARATIVE EXAMPLE 1

Carbon black was mixed with the phthalocyanine blue dispersing solution as described in Example 1 and then the mixture was dispersed using ultrasonic waves to prepare the composition for forming a conductive film. The conductive film was formed using the composition obtained above. The film state, film hardness, body color and appeal of the body color of the CRT having the conductive film, which are shown in Table 1, were measured.

COMPARATIVE EXAMPLE 2

With the exception of Ag being used instead of carbon black the composition for forming a conductive film was obtained in the same manner as described in Example 1, and the conductive film was formed using the composition. The film state, film hardness, body color and appeal of the body color of the CRT having the conductive film, which are shown in Table 1, were measured.

TABLE 1

| | Film state | Film hardness | Body color | Appeal of body color |
|---|---|---|---|---|
| Example 1 | transparent | 7 | bluish black | ◎ |
| Example 2 | transparent | 9 | bluish black | ◎ |
| Comparative Example 1 | occurrence of white turbidity | 3 | turbid black | Δ |
| Comparative Example 2 | transparent | 3 | yellow | Δ |

(Appeal of the body to the naked eye was classified as "very good", "good", "poor" and "very poor" states, which are represented by ◎, ○, Δ and x, respectively).

It is understood from Table 1 that the conductive films obtained in Examples 1 and 2 are transparent and hard, and exhibit a high-quality body color, while the conductive films obtained in Comparative Examples 1 and 2 are turbid due to white turbidity, and have poor film hardness and undesirable body color.

In the composition for forming a conductive film according to the present invention, the conductive black pigment particles are bonded to a network of an organic-inorganic composite sol while being uniformly dispersed in the network. Thus, the conductive film prepared using the composition of the present invention is stable even under a change of conditions such as temperature or humidity. Further, a CRT employing the conductive film formed using the conductive composition of the present invention is excellent in view of contrast characteristics, resolution and film properties, and has an improved body color and a good picture image.

What is claimed is:

1. A composition for forming a conductive film to be coated on the outer surface of a panel of a cathode ray tube, the composition comprising conductive black pigment particles, pigment particles for adjusting the transmittance of light at different wavelengths, a conductive polymer, and at least one silica selected from the group consisting of silicon alkoxide and oligomers thereof, wherein the conductive black pigment particles and pigment particles for adjusting the transmittance of light at different wavelengths are bonded to a network of an organic-inorganic composite sol and uniformly dispersed in the network.

2. The composition according to claim 1, wherein the conductive black pigment particles are at least one selected from the group consisting of carbon black and titanium black, and the average particle diameter thereof is 5~300 nm.

3. The composition according to claim 1, wherein the pigment particles for adjusting the transmittance of light at different wavelengths are at least one selected from the group consisting of organic or inorganic pigments, have a maximum transmittance in the wavelength range of 400–700 nm, and have an average particle diameter of 5~300 nm.

4. The composition according to claim 1, wherein the conductive polymer is at least one selected from the group consisting of polythiophene, polyaniline, polypyrrole, polyacetylene, polyfuran, polyparaphenylene, polyserenophene and derivatives thereof.

5. The composition according to claim 1, further comprising at least one binder selected from the group consisting of a silane coupling agent, metal alkoxide and silicon alkoxide oligomer.

6. The composition according to claim 1, further comprising conductive particles selected from the group consisting of metals and metal oxides.

7. The composition according to claim 1, wherein the panel is a flat panel having different transmittances between the center portion and the peripheral portion thereof.

8. A cathode ray tube comprising:

a panel; and a conductive film formed on the outer surface of the panel using the composition according to claim 1.

9. A cathode ray tube according to claim 8, the panel is a flat panel having different transmittances between the center portion and the peripheral portion thereof.

10. A cathode ray tube comprising:

a panel; and a conductive film formed on the outer surface of the panel using the composition according to claim 2.

11. A cathode ray tube comprising:

a panel; and a conductive film formed on the outer surface of the panel using the composition according to claim 3.

12. A cathode ray tube comprising:

a panel; and a conductive film formed on the outer surface of the panel using the composition according to claim 4.

13. A method for preparing a composition for forming a conductive film to be coated on the outer surface of a panel of a cathode ray tube, the method comprising the steps of:

(a) dispersing conductive black pigment particles, at least one silica selected from the group consisting of siliconalkoxide and oligomers thereof, and a conductive polymer, in an organic solvent mixture, to prepare an organic-inorganic composite sol;

(b) dispersing pigment particles for adjusting the transmittance of light at different wavelengths, a dispersing agent and a conductive polymer, in an organic solvent mixture, to prepare a pigment composition; and (d) mixing the organic-inorganic composite sol and the pigment composition, and subjecting the mixture to ultrasonic dispersion.

14. The method according to claim 13, wherein the conductive black pigment particles are at least one selected from the group consisting of carbon black and titanium black, and the average particle diameter thereof is 5~300 nm.

15. The method according to claim 13, wherein the pigment particles for adjusting the transmittance of light at different wavelengths are at least one selected from the group consisting of organic or inorganic pigments, have a maximum transmittance in the wavelength range of 400–700 nm, and have an average particle diameter of 5~300 nm.

16. The method according to claim 13, wherein the conductive polymer is at least one selected from the group consisting of polythiophene, polyaniline, polypyrrole, polyacetylene, polyfuran, polyparaphenylene, polyserenophene and derivatives thereof.

17. The method according to claim 13, wherein at least one binder selected from the group consisting of a silane coupling agent, metal alkoxide and silicon alkoxide oligomer is further added in step (a).

18. The method according to claim 13, wherein conductive particles selected from metals or metal oxides are further added in step (a).

19. The method according to claim 13, wherein step (a) is performed by dissolving conductive black pigment particles, pigment particles for adjusting the transmittance of light at different wavelengths, at least one silica selected from the group consisting of siliconalkoxide and oligomers thereof, and a conductive polymer, in an organic solvent mixture, and then subjecting the resultant to an aging procedure, to prepare an organic-inorganic composite sol.

20. The method according to claim 13, wherein the panel is a flat panel having different transmittances between the center portion and the peripheral portion thereof.

* * * * *